US006948680B2

(12) United States Patent
Ganster

(10) Patent No.: US 6,948,680 B2
(45) Date of Patent: Sep. 27, 2005

(54) DEVICE AND METHOD FOR STORING ELECTRIC CABLE AND ELECTRIC CABLE COMPONENTS

(75) Inventor: Gary Ganster, Lockport, IL (US)

(73) Assignee: Andrew Corporation, Orland Park, IL (US)

( * ) Notice: Subject to any disclaimer, the term of this patent is extended or adjusted under 35 U.S.C. 154(b) by 101 days.

(21) Appl. No.: 10/174,420

(22) Filed: Jun. 18, 2002

(65) Prior Publication Data

US 2003/0230667 A1 Dec. 18, 2003

(51) Int. Cl.[7] ..... B65H 75/18
(52) U.S. Cl. ..... 242/601; 206/400; 242/905
(58) Field of Search ..... 242/400, 407, 242/905, 601, 603, 614; 191/12.2 R; 206/397, 398, 399, 400, 401, 402

(56) References Cited

U.S. PATENT DOCUMENTS

| | | | | | |
|---|---|---|---|---|---|
| 1,861,294 | A | * | 5/1932 | Bartlett | 242/905 |
| 2,038,478 | A | | 4/1936 | Coombs | 68/3 |
| 2,367,214 | A | | 1/1945 | Hedge | |
| 3,493,105 | A | | 2/1970 | Greb et al. | 206/59 |
| 4,451,013 | A | * | 5/1984 | Bedrosian | 242/118.4 |
| 4,657,140 | A | * | 4/1987 | Zagar et al. | 206/397 |
| 4,880,182 | A | | 11/1989 | Gelfman | 242/117 |
| 5,366,085 | A | | 11/1994 | Kewin | 206/407 |
| 5,494,168 | A | * | 2/1996 | Hart | 206/714 |
| 5,676,250 | A | | 10/1997 | Walters | 206/419 |
| 5,695,148 | A | * | 12/1997 | Christensen | 242/613 |
| 5,794,775 | A | | 8/1998 | Hall | 206/388 |
| 5,873,464 | A | * | 2/1999 | Haley | 206/398 |
| 5,921,391 | A | | 7/1999 | Ortiz et al. | 206/397 |
| 5,957,401 | A | * | 9/1999 | O'Donnell | 242/404.3 |
| 6,024,317 | A | * | 2/2000 | Kovacik et al. | 242/405.1 |
| 6,431,489 | B1 | * | 8/2002 | Rose | 242/402 |
| 6,467,623 | B1 | * | 10/2002 | Lewis et al. | 206/388 |
| 6,557,792 | B1 | * | 5/2003 | Snow | 242/407 |
| 2002/0050291 | A1 | | 1/2002 | Morris et al. | |

* cited by examiner

*Primary Examiner*—Kathy Matecki
*Assistant Examiner*—Scott J. Haugland
(74) *Attorney, Agent, or Firm*—Barnes & Thornburg LLP

(57) ABSTRACT

A device and method for storing an electric cable of predetermined length and at least one electric cable component. The device comprises a reel having a drum around which the electric cable can be wound and a pair of flanges disposed about the drum, the drum and flanges defining a well; and at least one container disposed within the well and secured to the reel, the container defining a cavity for receiving the electric cable component. The device may also include a lagging for enclosing at least a portion of the well. The container may have any suitable construction and configuration and may be secured to the reel at any suitable location and in any suitable manner. The container may be secured in any suitable manner to the lagging in accordance with another embodiment. The method may comprise winding the electric cable around the drum and within the well, and placing the electric cable component within the cavity. The method may further include coupling the lagging to the reel.

52 Claims, 4 Drawing Sheets

DEVICE AND METHOD FOR STORING ELECTRIC CABLE AND ELECTRIC CABLE COMPONENTS

The present invention relates to the storage of electric cable and electric cable components.

BACKGROUND

Reels are typically used to store, transport and protect electronic transmissions cable or other electric cable. The electric cable is wound around a drum of the reel within the well of the reel, and lagging is secured to the reel to enclose the well and cover the electric cable to protect the cable. Reels of electric cable are usually sold or otherwise distributed with electric cable components, such as, for example, connectors, hanger kits, hoisting grips, etc. The components typically may be stored in bags, boxes or the like apart from the reel or secured directly to the cable.

DETAILED DESCRIPTION OF ILLUSTRATIVE EMBODIMENTS

Figure 1:
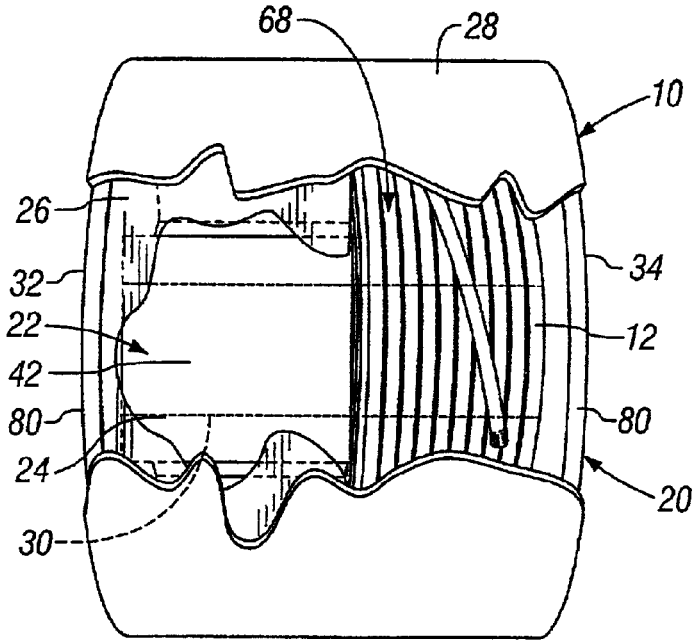
FIG. 1 is a perspective cut-away view of a device storing electric cable and electric cable components.
Figure 2:
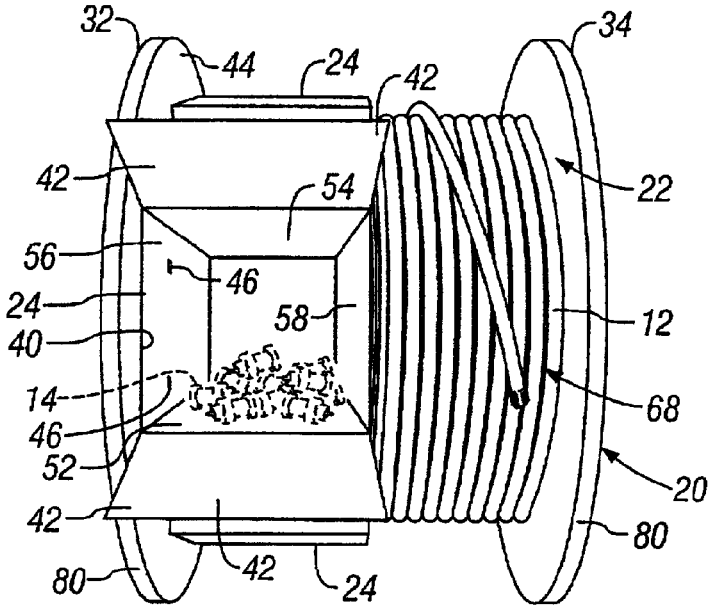
FIG. 2 is a perspective view of the device of FIG. 1, with the lagging and wrap removed and one of the containers open to illustrate the electric cable components contained within the container.

FIGS. 1–2 provide an illustrative embodiment of a device 10 for storing electric cable 12 and electric cable components 14. The illustrated device 10 includes a reel 20 that defines a well 22, a plurality of containers 24 secured to the reel, a wrap 26, and a lagging 28 for enclosing the well. The illustrated reel 20 comprises a generally cylindrical drum 30 around which the electric cable 12 is wound and a pair of disk-shaped flanges 32 and 34 disposed on opposite sides of the drum. The reel 20 may have any other suitable construction in accordance with other embodiments, and may be constructed of wood, metal, plastic or any other suitable material. The drum 30 and flanges 32 and 34 may be assembled together in any suitable manner. The well 22 is bounded by the lagging 28, the drum 30 and flanges 32 and 34.

Each of the illustrated containers 24 is generally rectangular, defines a cavity 40 for receiving the electric cable components 14, and includes a pair of pivotable top flaps 42 for enclosing the cavity. The illustrated containers 24 are secured to the inner wall 44 of the flange 32 by staples 46, nails, or any other suitable fastening elements or in any other suitable manner. Each container 24 may have any other suitable configuration and construction, and may be secured to the reel 20 in any other suitable manner and at any other suitable location in accordance with other embodiments. The containers 24 may, for example, be secured to the other flange 34, to the drum 30, or to the lagging 28 by staples, nails or any other suitable fastening element or in any other suitable manner. By way of further example, the containers may be any other suitable enclosure or combination of enclosures having any suitable construction and configuration that may be wrapped around the drum or may otherwise be secured to the reel or lagging in any suitable manner in accordance with other embodiments.

Each of the illustrated containers 24 further includes a bottom 50 that is positioned on or otherwise contacting the drum 30, a front 52, a back 54, and a pair of opposed sides 56 and 58. The side 58 of each illustrated container 24 and the flange 34 define a cable storage well 68 for receiving the electric cable 12. In the illustrated embodiment, the sides 58 of the containers 24 and the flange 34 provide the boundary surfaces for the wound electric cable 12. In accordance with another embodiment, the cable storage well may instead be defined by the flanges 32 and 34, such that the electric cable 12 is wound around the drum 30 substantially along the length of the drum. In the illustrated embodiment, three containers 24 are shown but, in accordance with other embodiments, there may be more or less containers.

Each of the illustrated containers 24 is constructed of high density polyethylene. Such material is strong and rigid enough such that it can be secured to the reel, support the electric cable components 14 stored in the cavity 40 of the container 24, and withstand the pressure applied by the wrap 26 described hereinafter. Such material also is able to withstand weather elements, such as moisture and temperature changes. The material may be corrugated. The containers 24 may be constructed of any other suitable material or combination of materials in accordance with other embodiments, such as, for example, any other type of plastic, metal, wood, cardboard, nylon, mylar, paper or the like.

Figure 5:
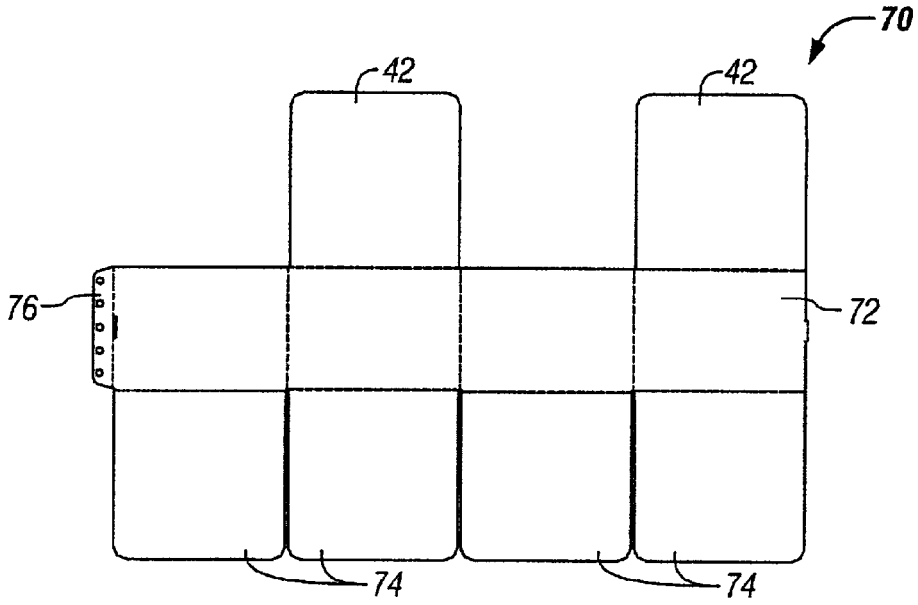
FIG. 5 is a side plan view of a panel assembly for assembling one of the containers of FIGS. 1–2.

Each of the illustrated containers 24 is assembled from a panel assembly 70, which may provide economies and efficiencies during the storing process (see, e.g., FIG. 5). The illustrated panel assembly 70 can be quickly and easily assembled to form the respective container 24 for securing to the flange. The illustrated panel assembly 70 includes a central portion 72, four bottom flaps 74, and the pair of top flaps 42. The central portion 72 includes a weld flap 76 that is sonic welded to the opposed end of the central portion. The containers 24 may be constructed, formed or assembled in any other suitable manner in accordance with other embodiments.

Figure 6:
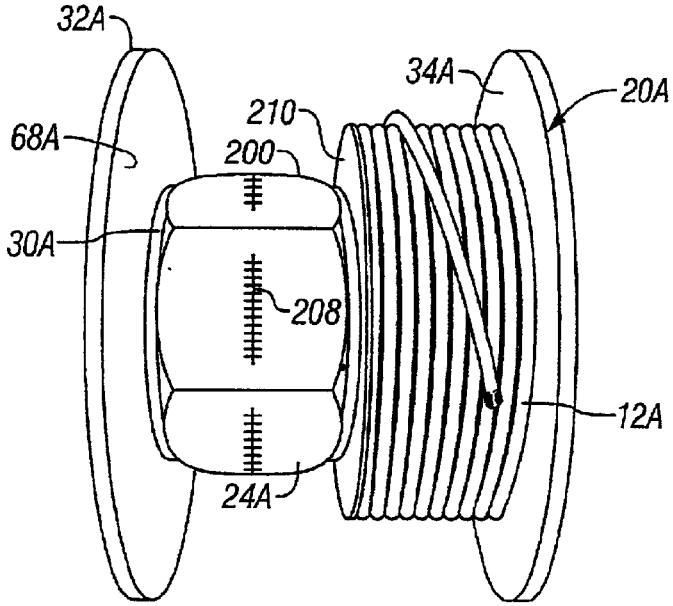
FIG. 6 is a perspective view of a device storing electric cable and electric cable components in accordance with another embodiment.
Figure 7:
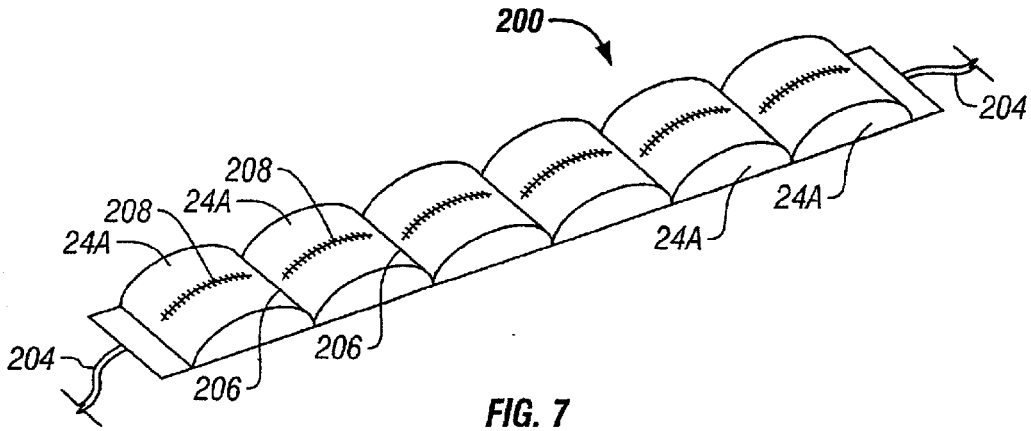
FIG. 7 is a perspective view of the container structure of FIG. 6 before it is secured to the reel.

By way of further example, FIGS. 6 and 7 illustrate an alternative embodiment including an elongated container structure 200 comprising a series of connected containers 24A. The illustrated container structure 200 is flexible and adapted to be wrapped around the drum 30A of the reel 20A and have its opposed ends secured together by ties 204, staples, a hook and loop fastener or any other suitable means to secure it to the drum. The illustrated container structure 200 may be fabricated, for example, from a sheet plastic with heat sealed joints 206. Access to electric cable components within the cavities of the individual containers 24A may be gained through one or more openings 208 defined by the container. The openings 208 may, for example, be sheet material overlaps or slits closed with slide locks, a hook and loon fastener, snap tabs or any other suitable closure. The container structure 200 and the individual containers 24A may be constructed, formed or assembled in any other suitable manner in accordance with other embodiments.

The embodiment illustrated in FIGS. 6 and 7 may be used in any suitable application, such as, for example, a flat pack application wherein the electric cable components are not large. The illustrated embodiment includes a divider 210 which, together with flange 34A, serve as boundary walls for the electric cable 12A and define the cable storage well 68A. The illustrated divider 210 is disk shaped. The divider 210 may, for example, have tabs (not shown) extending under the electric cable to support the divider in a radial attitude. The embodiment of FIGS. 6 and 7 may be modified in any suitable manner in accordance with further embodiments. For example, in a further embodiment, the entire width of the drum may be used to store the electric cable 12A and the containers may be secured to the reel by extending the container structure around the cable. With such embodiment, the container structure 200 may be secured to the reel 20A by wrapping it around the drum 30A over a full drum length of cable winding (not shown).

Figure 3:
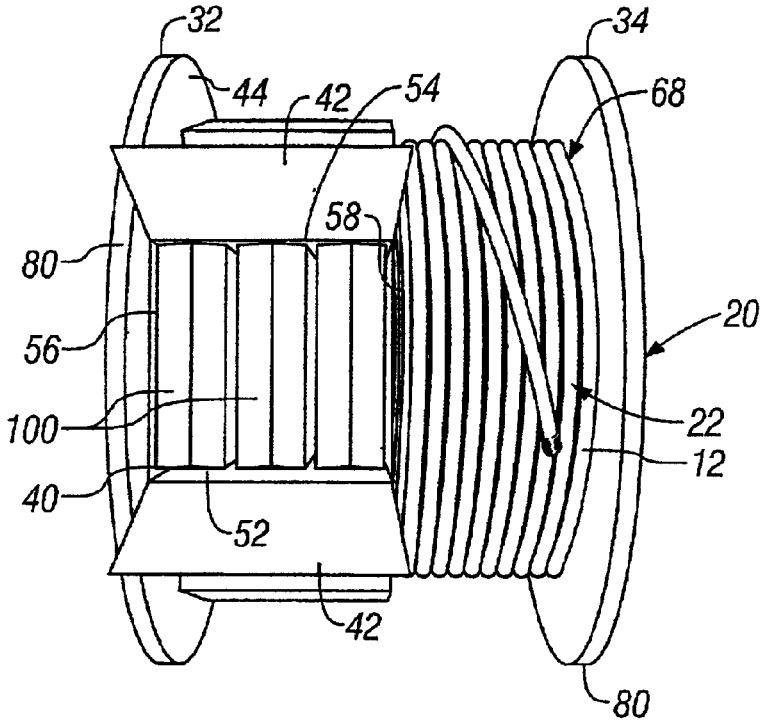
FIG. 3 is a perspective view similar to FIG. 2, except that in this embodiment the electric cable components are contained within boxes stored within the container.
Figure 4:
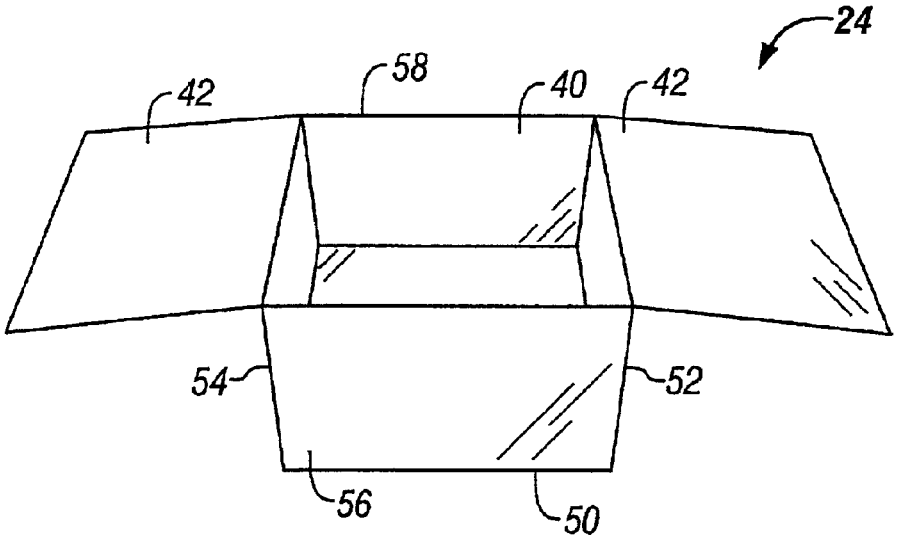
FIG. 4 is a perspective view of one of the containers of the device of FIGS. 1–2.
Figure 8:
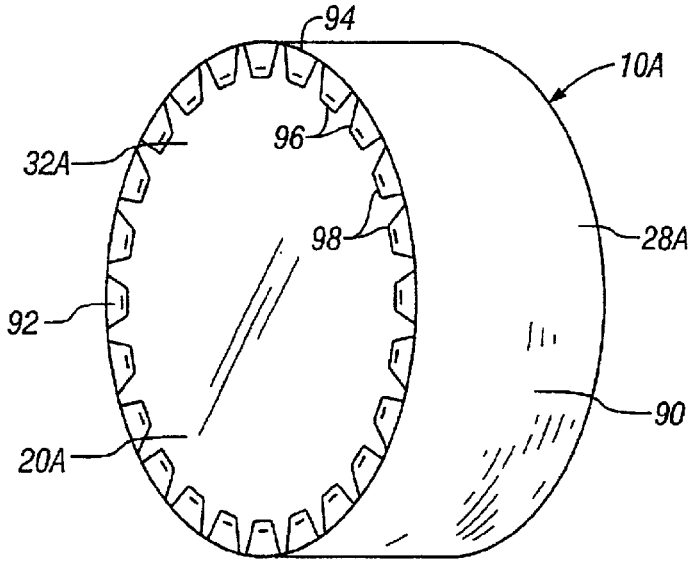
FIG. 8 is a perspective view of a device storing electric cable and electric cable components in accordance with another embodiment.

The lagging 28 illustrated in FIG. 1 is a sheet that is secured to the flanges 32 and 34, and extends around the reel 20 to enclose the well 22. The lagging 28 is formed of a plurality of plywood panels that are joined together linearly and then positioned around the reel 20 to form a generally cylindrical configuration. The lagging 28 is secured to the rim surfaces 80 of the flanges 32 and 34 by nails, staples or by any other suitable fastening elements or in any other suitable manner. The lagging 28 encloses the well 22 to protect the electric cable 12 and the electric cable components 14. The lagging 28 may enclose only a portion of the well 22 in accordance with other embodiments. The lagging 28 may be constructed of any other suitable materials, may have any other suitable construction, and may be secured or otherwise coupled to the reel in any other suitable manner in accordance with other embodiments. The lagging may, for example, be of the type illustrated in FIG. 8 and disclosed in published U.S. patent application Ser. No. 2002 0005029A1, entitled "Reel Wrap." In this embodiment (FIG. 8), the lagging 28A is corrugated and multi-layered and is constructed of high-density polyethylene. The lagging 28A includes a central portion 90, which extends between the flanges of the reel 20A, and two lateral portions 92 that are unitary with the central portion. The lateral portions 92 are joined at a respective side margin 94 of the central portion 90. Each lateral portion 92 includes a plurality of tabs 96 that include angled sides. The tabs 96 may be joined to the flanges by staples 98 or any other suitable fastening elements or in any other suitable manner. While the use of lagging is desirable for many applications, particularly where adverse environmental conditions may be encountered by the completed reel assembly, it is not necessary for all applications and may be eliminated as shown, for example, in FIGS. 2, 3 and 6.

The wrap 26 may be any suitable wrap, including, for example, a stretch wrap or other plastic or non-plastic wrap or the like, that illustratively is wrapped around the drum 30 as it is wrapped around the containers 24. The wrap 26 may further secure the containers 24 to the reel 20 and may also protect the electric cable components 14 contained in the containers 24 from moisture or weather conditions. The wrap 26 may also be used to maintain the top flaps 42 of the illustrated containers in their closed positions. The wrap 26 may instead be wrapped individually around each container 24 in accordance with another embodiment.

The illustrated electric cable 12 or 12A is in the form of electronic transmissions cable, which may have any suitable length, diameter and construction. The electric cable 12 may be any other type of electric cable in connection with other embodiments. The illustrated electric cable components 14 are connectors for use in connection with the illustrated electric cable. The electric cable components 14 may instead be any other form of electric cable components for use with the electric cable, such as, for example, any other type of connectors, hoisting grips or any other components that might be sold, distributed or transported with electric cable. The particular number and type of electric cable components 14 stored in the containers 24 may vary depending upon many factors, including, for example, the type of electric cable, its intended application, or the customer specifications.

In the embodiment of FIGS. 1–2, the electric cable components 14 are stored directly in the container 24. The electric cable components 14 may instead be contained within any suitable box or other package that is stored within the container 24. In the embodiment illustrated in FIG. 3, for example, the electric cable components are contained within cardboard boxes 100 stored within the containers 24. The packages may have any other suitable configuration and construction in accordance with other embodiments.

In the illustrated embodiment, a method of storing the electric cable 12 and electric cable components 14 may include winding the electric cable around the drum 30, placing the electric cable components 14 in the cavities 40 defined by the containers 24 and securing the lagging 28 to the reel 20. The electric cable components 14 may be placed directly in the containers 24 or may be contained within one or more packages stored within the containers. In the illustrated embodiment, the electric cable 12 is disposed within the cable storage well 68. The method may also include enclosing the cavities 40 by closing the flaps 42 of the containers 24 and by wrapping the wrap 26 around the containers 24 and the drum 30.

While preferred embodiments of the present invention are shown and described, it is envisioned that those skilled in the art may devise various modifications of the present invention without departing from the spirit and scope.

What is claimed:

1. A device for separately storing an electric cable of predetermined length and at least one electric cable component separated from the electric cable, the device comprising:

(a) a reel having a drum having an electric cable winding surface around which the electric cable can be wound and a pair of flanges disposed about the drum, the drum and flanges defining a well exterior to the drum; and (b) at least one container disposed within the well and removably secured to the reel, the container defining a cavity for receiving the electric cable component apart from the electric cable and located so that the electric cable winding surface is exposed.

2. The device of claim 1 further comprising a lagging coupled to the reel to enclose at least a portion of the well.

3. The device of claim 1 wherein the container is secured to one of the flanges.

4. The device of claim 3 wherein the container is secured to the one flange by at least one fastening element.

5. The device of claim 1 wherein the container includes a bottom surface in contact with the drum.

6. The device of claim 1 wherein the drum, the container and one of the flanges define a cable storage well for receiving the cable.

7. The device of claim 6 wherein the container is secured to the other flange.

8. The device of claim 7 wherein the container includes a bottom surface in contact with the drum.

9. The device of claim 1 further including a wrap for wrapping around the container.

10. The device of claim 1 further comprising a plurality of containers, and wherein the drum, the containers and one of the flanges define a cable storage well for receiving the cable.

11. The device of claim 10 wherein the containers are secured to the other flange.

12. The device of claim 10 further including a wrap for wrapping around the drum and containers.

13. The device of claim 1 wherein the container is assembled from a panel assembly.

14. The device of claim 1 wherein the container is constructed of high density polyethylene.

15. The device of claim 1 further including a hook and loop fastener removably securing the container to the reel.

16. A device for separately storing an electric cable of predetermined length and at least one electric cable component separated from the electric cable, the device comprising:

(a) a reel having a drum having an electric cable winding surface around which the electric cable can be wound and a pair of flanges disposed about the drum, the drum and flanges defining a well exterior to the drum; and (b) at least one container disposed within the well and secured to the reel, the container defining a cavity for receiving the electric cable component apart from the electric cable and located so that the electric cable winding surface is exposed, and wherein the container includes at least one flap movable to a closed position for enclosing the cavity of the container.

17. The device of claim 16 further comprising a wrap for maintaining the flap in the closed position.

18. A device for storing an electric cable of predetermined length and at least one electric cable component, the device comprising:

(a) a reel having a drum around which the electric cable can be wound and a pair of flanges disposed about the drum, the drum and flanges defining a well exterior to the drum; and (b) at least one container disposed within the well and secured to the reel, the container defining a cavity for receiving the electric cable component, and wherein the container includes a pair of flaps movable to closed positions for enclosing the cavity of the container.

19. A device for separately storing an electric cable of predetermined length and at least one electric cable component separated from the cable, the device comprising:

(a) a reel having a drum having an electric cable winding surface around which the electric cable can be wound and a pair of flanges disposed about the drum, the drum and flanges defining a well exterior to the drum; and (b) at least one container disposed within the well and secured to the reel, the container defining a cavity for receiving the electric cable component apart from the electric cable and located so that the electric cable winding surface is exposed; and further comprising a plurality of containers, and wherein the drum, the containers and one of the flanges define a cable storage well for receiving the cable, the containers are secured to the other flange; and wherein each container has a length extending from the other flange toward the one flange, the lengths of the containers being approximately the same.

20. A device for separately storing an electric cable of predetermined length and at least one electric cable component separated from the cable, the device comprising:

(a) a reel having a drum having an electric cable winding surface around which the electric cable can be wound and a pair of flanges disposed about the drum, the drum and flanges defining a well exterior to the drum; and (b) at least one container disposed within the well and secured to the reel, the container defining a cavity for receiving the electric cable component apart from the electric cable and located so that the electric cable winding surface is exposed; and further comprising a plurality of containers, and wherein the drum, the containers and one of the flanges define a cable storage well for receiving the cable and wherein each of the containers includes a bottom surface in contact with the drum.

21. A method for separately storing an electric cable of predetermined length and at least one electric cable component separated from the electric cable, the method comprising:

(a) winding the electric cable around a drum of a reel within a well exterior of the drum of the reel and outside of a cavity defined apart from the electric cable by a container secured to the reel and disposed within the well; and (b) placing the electric cable component within the cavity.

22. The method of claim 21 further including coupling a lagging to the reel to enclose at least a portion of the well.

23. The method of claim 21 wherein the reel includes a pair of flanges disposed about the drum and wherein during the winding of the electric cable the electric cable is wound around the drum within a cable storage well defined by one of the flanges, the container and the drum.

24. The method of claim 21 wherein a plurality of containers, including the container, are secured to the reel and disposed within the well and a plurality of electric cable components, including the electric cable component, are placed within the cavities of the containers.

25. The method of claim 24 wherein the reel includes a pair of flanges disposed about the drum and wherein during the winding of the electric cable the electric cable is wound around the drum within a cable storage well defined by one of the flanges, the containers and the drum.

26. The method of claim 21 further including enclosing the cavity after the placing of the electric cable component within the cavity.

27. The method of claim 21 including a plurality of electric cable components, including the electric cable component, and a plurality of containers, including the container, and further including wrapping the containers with a wrap after the placing of the electric cable components within the cavities.

28. The method of claim 27 wherein during the wrapping of the containers the wrap is also wound around the drum.

29. The method of claim 21 further including assembling the container from a panel assembly prior to the placing of the electric cable component within the cavity.

30. The method of claim 21 further including coupling a lagging to the reel to enclose substantially the entire well.

31. A method for separately storing an electric cable of predetermined length and at least one electric cable component separated from the electric cable, the method comprising:

(a) winding the electric cable around a drum of a reel and within a well defined by the reel and located exterior of the drum; and (b) placing the electric cable component within a cavity defined apart from the electric cable by a container secured to the reel and disposed within the well, including enclosing the cavity after the placing of the electric cable component within the cavity and wherein the enclosing of the cavity includes moving a flap of the container to a closed position.

32. The method of claim 31 further including wrapping the container with a wrap to maintain the flap in the closed position.

33. A method for storing an electric cable of predetermined length and at least one electric cable component, the method comprising:

(a) winding the electric cable around a drum of a reel and within a well defined by the reel, (b) placing the electric cable component within a cavity defined by a container secured to the reel and disposed within the well (c) assembling the container from a panel assembly prior to the placing of the electric cable component within the cavity, and wherein the panel assembly comprises four bottom flaps and a pair of top flaps and further including enclosing the cavity after the placing of the electric cable components within the cavity by moving the pair of top flaps to closed positions.

34. A kit comprising:

(a) a reel having a drum and a pair of flanges disposed about the drum defining a well exterior of the drum;

(b) a container disposed within the well and secured to the reel, the container defining a cavity apart from the electric cable;

(c) an electric cable of predetermined length wound around the drum and disposed within the well and so as to not extend into the cavity; and (d) at least one electric cable component stored separately from the electric cable, the electric cable stored within the cavity separate from the electric cable.

35. The kit of claim 34 further including a lagging coupled to the reel substantially enclosing the well.

36. The kit of claim 34 wherein the drum, the container and one of the flanges define a cable storage well, the electric cable being disposed within the cable storage well.

37. The kit of claim 36 wherein the container is secured to the other flange.

38. The kit of claim 34 wherein the container includes a bottom surface contacting the drum.

39. The kit of claim 34 wherein the container is secured to one of the flanges.

40. The kit of claim 34 further including a wrap wrapped around the container and the drum.

41. The kit of claim 34 further comprising a plurality of the containers, including the container, disposed within the well and secured to the reel, and wherein the drum, the containers and one of the flanges define a cable storage well receiving the cable.

42. The kit of claim 41 wherein the containers are secured to the other flange.

43. The kit of claim 41 further including a wrap for wrapping around the drum and containers.

44. The kit of claim 34 wherein the container is assembled from a panel assembly.

45. A kit comprising:

(a) a reel having a drum and a pair of flanges disposed about the drum defining a well exterior of the drum;

(b) a container disposed within the well and secured to the reel, the container defining a cavity;

(c) an electric cable of predetermined length wound around the drum and disposed within the well; and (d) at least one electric cable component stored separately from the electric cable, the electric cable component stored within the cavity separate from the electric cable, and wherein the container includes at least one flap in a closed position enclosing the cavity of the container.

46. The kit of claim 45 further comprising a wrap maintaining the flap in the closed position.

47. A kit comprising:

(a) a reel having a drum and a pair of flanges disposed about the drum defining a well exterior of the drum;

(b) a container disposed within the well and secured to the reel, the container defining a cavity;

(c) an electric cable of predetermined length wound around the drum and disposed within the well, the cavity being apart from the electric cable; and (d) at least one electric cable component stored separate from the electric cable, the electric cable component stored within the cavity and separated from the electric cable, further comprising a plurality of containers, and wherein the drum, the containers and one of the flanges define a cable storage well receiving the cable and wherein the containers are secured to the other flange, and wherein each container has a length extending from the other flange toward the one flange, the lengths of the containers being approximately the same.

48. A kit comprising:

(a) a reel having a drum and a pair of flanges disposed about the drum defining a well;

(b) a plurality of containers, including the container, disposed within the well and secured to the reel, each container defining a cavity;

(c) an electric cable of predetermined length wound around the drum and disposed within the well, each cavity defined apart from the electric cable; and (d) at least one electric cable component stored separate from the electric cable, the electric cable component stored within one of the cavities;

wherein the drum, the containers and one of the flanges define a cable storage well receiving the cable, and wherein each of the containers includes a bottom surface in contact with the drum.

49. A device for separately storing an electric cable of predetermined length and at least one electric cable component separated from the electric cable, the device comprising:

(a) a reel having a drum having an electric cable winding surface around which the electric cable can be wound and a pair of flanges disposed about the drum, the drum and flanges defining a well exterior of the drum;

(b) a lagging coupled to the reel to enclose at least a portion of the well; and (c) at least one container disposed within the well and removably secured to the reel, the container defining a cavity for receiving the electric cable component apart from the electric cable and located so that the electric cable winding surface is exposed.

50. The device of claim 49 wherein the drum, the container and one of the flanges define a cable storage well for receiving the cable.

51. The device of claim 49 further comprising a plurality of containers, and wherein the drum, the containers and one of the flanges define a cable storage well for receiving the cable.

52. The device of claim 49 further including a hook and loop fastener removably securing the container to the reel.

* * * * *